United States Patent [19]

Gillingwater

[11] 4,155,165

[45] May 22, 1979

[54] PICTURE MAT MARKING INSTRUMENT

[76] Inventor: Abel R. Gillingwater, Rte. 3, Box 14A, Depauw, Ind. 47115

[21] Appl. No.: 936,874

[22] Filed: Aug. 25, 1978

[51] Int. Cl.[2] ..... B43L 7/00

[52] U.S. Cl. ..... 33/104; 33/112; 33/96

[58] Field of Search ..... 33/75 R, 112, 113, 104, 33/95, 96, 94, 97

[56] References Cited

U.S. PATENT DOCUMENTS

| | | | |
|---|---|---|---|
| 313,197 | 3/1885 | Gaylord | 33/112 |
| 513,665 | 1/1894 | Barberie | 33/191 X |
| 778,521 | 12/1904 | Wheat | 33/42 |
| 1,584,507 | 11/1926 | Bulling | 33/104 |
| 1,845,449 | 2/1932 | Smith | 33/104 |
| 2,080,620 | 5/1937 | Martin | 33/104 |
| 2,247,362 | 7/1941 | Dibble | 33/104 |
| 2,610,407 | 9/1952 | McQuaid | 33/104 |
| 3,156,984 | 11/1964 | Palmer | 33/174 G X |
| 3,381,382 | 5/1968 | Kemp | 33/104 |
| 3,687,770 | 8/1972 | Chase | 156/221 |
| 4,027,396 | 6/1977 | Pierce | 33/112 X |

*Primary Examiner*—Harry N. Haroian

*Attorney, Agent, or Firm*—Woodard, Weikart, Emhardt & Naughton

[57] ABSTRACT

An instrument for marking, in preparation for subsequent cutting, of picture mat stock utilized in producing octagonal single or dual matting of pictures, comprising a base plate having a right angle indentation in one of its margins for accommodating the right angle corner of unmarked mat stock and a rectilinear base margin for accommodating the adjustably positionable transverse member of a conventional framer's T-square, a mid-plate secured to and overlying the base plate having coincident margins therewith but whose right angle indentation is parallel to but spaced from that of the base plate and two top plates secured to the mid plate having inclined margins coincident with the right angle indentation of the base plate, the top plates being laterally truncated to form a channel over said mid-plate to freely receive the shank portion of the framer's T-square.

3 Claims, 9 Drawing Figures

PICTURE MAT MARKING INSTRUMENT

BACKGROUND OF THE INVENTION

The marking and subsequent cutting of mats of octagonal aperture design present difficulties. While four of the octagonal mat aperture sides are parallel to the outer rectangular margin of the mat, the other four sides of the octagonal aperture are each uniformly inclined at 45° with the adjacent outer margin of the mat. Particularly where a second inter liner or inner mat is used, having a somewhat smaller octagonal aperture whose sides are parallel to the octagonal aperture in the outer mat, marking and cutting difficulties arise. While linear measure can be used (with the outer margin of the outer mat as a reference) to locate the sides of the mat apertures (inner and outer) parallel to the outer mat margin, when the diagonal or 45° lines are marked, unless a mathematical calculation is made, a triangulation error is introduced (as will be subsequently explained in detail) which causes the width of the border between the inner and outer mat apertures to be narrower at the 45° lines. Loss of symmetry of appearance resulting from this difficulty can make the mat unacceptable. Either increased scrap loss or increased time and computational skill in marking had to be tolerated, heretofore, to avoid this problem.

The instrument of the present invention, used with a conventional framer's T-square, provides a means for transferring the 45° marking lines to the corner of a mat without applying a numerical value to the given border measurements of the mat and, further, avoids the triangulation error introduced when conventional measuring techniques are used in marking the inner one of dual mats.

DESCRIPTION OF THE PREFERRED EMBODIMENTS

Figure 1:
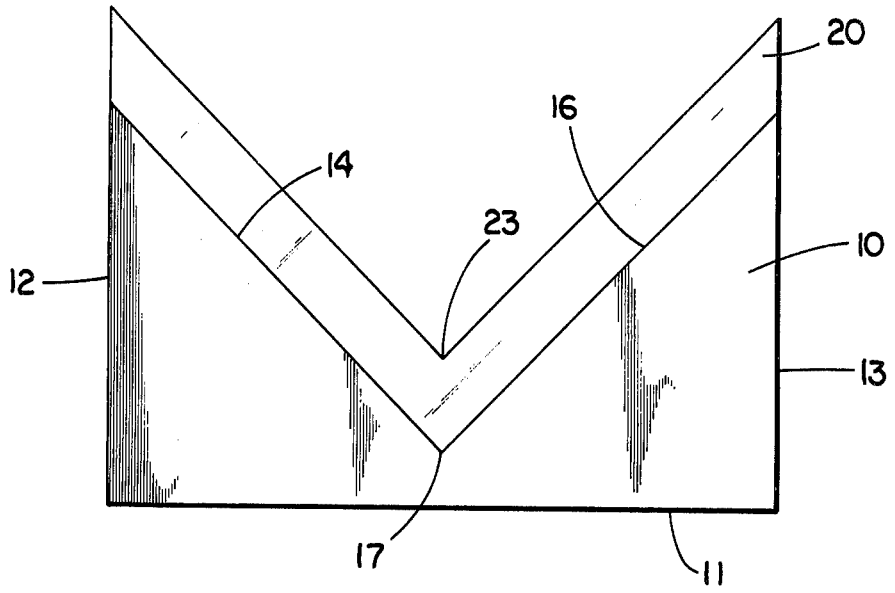
FIG. 1 is a bottom plan view of an instrument embodying the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
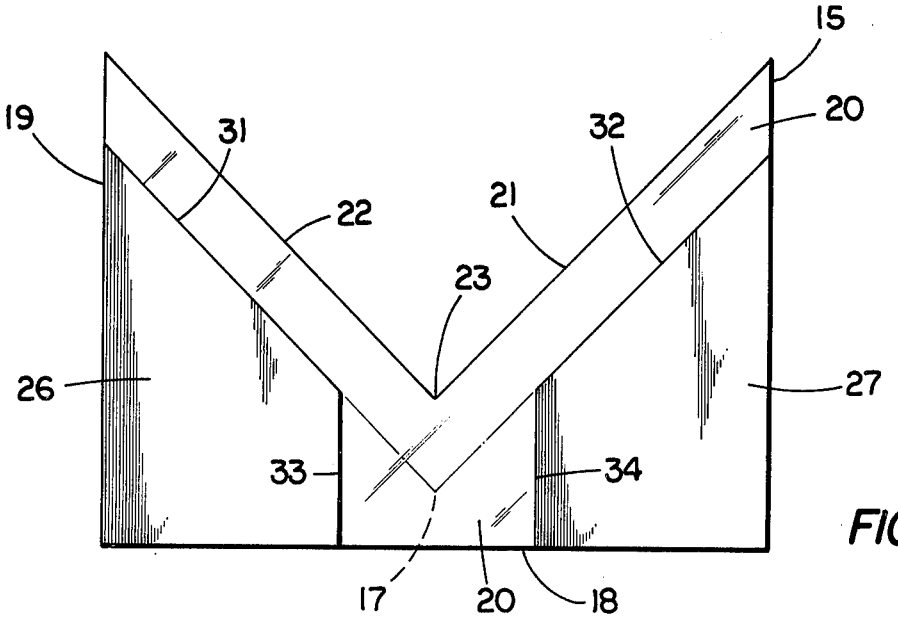
FIG. 2 is a top plan view of the instrument.
Figure 3:
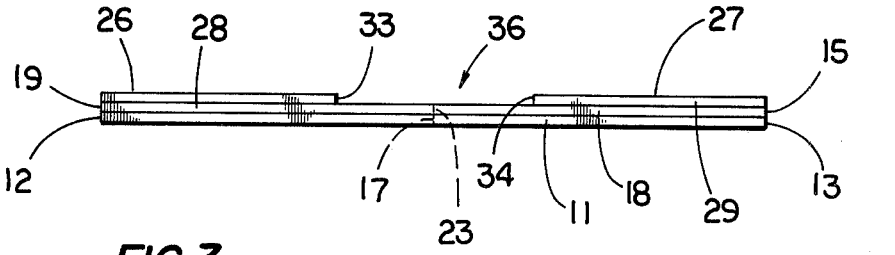
FIG. 3 is an end view taken from the base end of the structure of FIGS. 1 and 2.

The instrument embodying the present invention is described with reference to FIGS. 1–3 and includes a base plate 10 having a rectilinear base margin 11 and side margins 12 and 13. The end margin opposite margin 11 is formed to provide a right angle indentation whose intersecting sides 14 and 16 form the right angle indentation. The apex 17 of the right angle is located at the center line of the plate 10 and is spaced from the base margin 11.

The mid-plate 20 overlies and is rigidly adhered to the base plate 10. The mid-plate has a rectilinear base or end margin 18, which is coincident with the margin 11 of plate 10, and has side margins 15 and 19 (FIG 3). The end margin of plate 20 opposite margin 18 is formed to provide a right angle indentation whose intersecting sides forming the right angle are identified at 21 and 22. The apex 23 of the right angle is spaced from apex 17 of plate 10 and although base margin 18 coincides with margin 11 of the plate 10, the margins 21 and 22, meeting at 23, are parallel to but spaced longitudinally from margins 14 and 16 of plate 17 so as to overhang the idented margin (formed by lines 14 and 16) of the base plate 10.

Fixedly mounted on the upper face of plate 20 are two quadrilateral top plates 26 and 27. Their base margins 28 and 29, respectively, are coincident with base margins 18 and 11 of plates 10 and 20 and the outer side margins of plates 26 and 27 are also coincident with the side margins of the underlying mid-plate and base plate. The inclined end margins 31 and 32 (FIG. 2) are parallel to and directly overlie the margin lines 14 and 16 of base plate 10 and are parallel to but spaced from the margin lines 21 and 22 of plate 20. The top plates are laterally truncated so that their margins 33 and 34 provide a channel 36 (FIG. 3) over the mid-plate 20 for freely accommodating the shank of a conventional, framer's T-square, as will subsequently be explained with reference to FIGS. 6 and 7.

Figure 4:
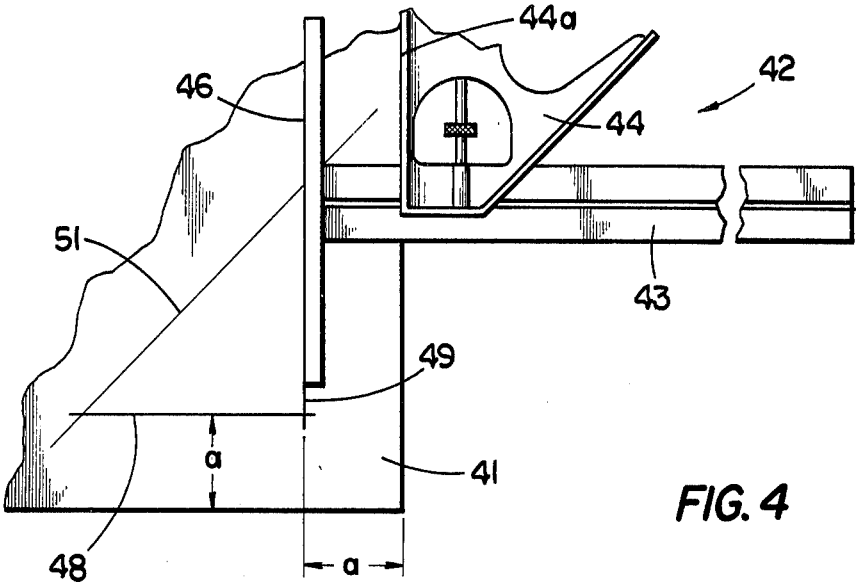
FIG. 4 is a fragmentary, top plan view of a mat being marked in conventional fashion.
Figure 5:
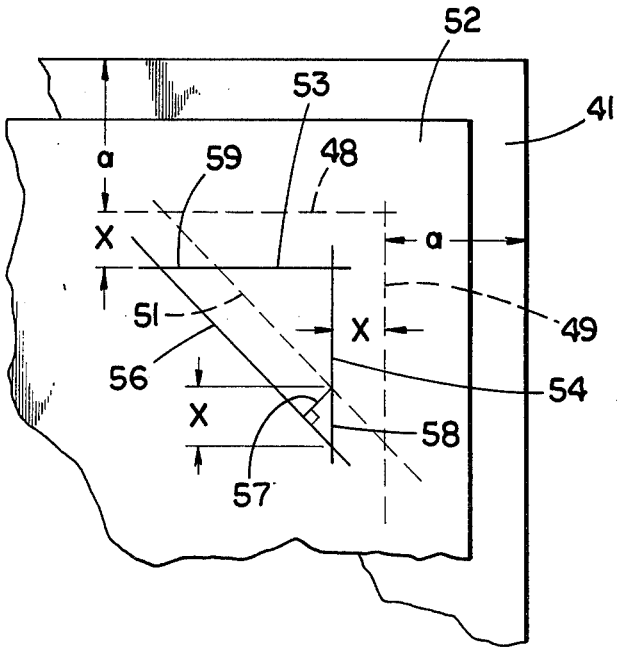
FIG. 5 is a fragmentary view similar to FIG. 4 but showing the inner mat overlying the outer mat and dimensioned to illustrate the triangulation error introduced in conventional marking of the inner mat.
Figure 6:
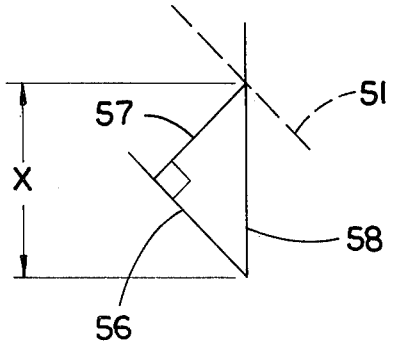
FIG. 6 is an enlarged fragment from FIG. 5.

Referring to FIGS. 4, 5 and 6, conventional marking of a rectangular piece of mat stock 41 for an octagonal aperture proceeds using a conventional framer's T-square indicated generally at 42 in FIG. 4. The T-square consists of a metal shank 43 inscribed with suitable scale markings and carries an adjustably positionable cross-head or base member 44 which by means of knurled nut **44*a*, can be clamped on the shank at any selected location. A cross-bar 46 is rigidly secured at right angles to the shank 43. It will be understood that the framer's T-square, itself, while used with the instrument of the present invention described with reference to FIGS. 1–3**, forms no part of the present invention.

As indicated in FIG. 4, in conventionally marking the initial or base mat 41, the border dimension a is choosen which is the result of an artistic judgment based on a balancing of the frame width, type of picture to be exposed through the mat aperture, etc. Border lines 48 and 49, parallel to the mat outer margin are then marked at all four corners of the mat 41 using the framer's square 42 as indicated in FIG. 4. Measuring along both lines 48 and 49 from their junction at each corner and marking a uniform selected length provides the guide for drawing the 45° line 51 (FIG. 4) at each corner. This marking indicates the octagonal aperture which is then cut from the mat by utilizing a conventional mat cutter (not shown), the cut usually being a bevel cut. After cutting the octagonal aperture, the central removed piece must be fitted back into the aperture in preparation for marking and cutting the inner mat to be explained with reference to FIGS. 5 and 6. Primarily because of the duplicate length measuring and marking, with a rule, along the border-parallel lines (48 and 49) at each corner to establish the 45° lines 51, the octagonal removed portion, after cutting the mat 41, is usually out-of-true sufficiently to permit its fitting into the octagonal aperture in only one orientation, that corresponding to its position before the mat was cut. In this conventional marking and cutting procedure, the operator must thus use additional production time to correctly orient and refit the removed portion back into the aperture.

The triangulation error, previously referred to, occurs in the marking of the inner mat to be stacked on the mat 41, this conventional inner mat marking procedure being illustrated in FIG. 5. FIG. 5 shows the rear face of outer mat 41 and the rear face of overlying inner mat 52. The lines 48 and 49 and 45° line 51 on the outer mat are, in this view, shown as broken lines because they are hidden by the overlying inner mat 52. The dimension x (again, an artistic judgment and representing the width of the border that will appear between the octagonal inner margins of the inner and outer mats when mounting and framing of the picture is completed) having been chosen, the framer's square 42 may be utilized (after advancing the member 44 an amount equal to x on the shank or scale 43) to draw the lines 53 and 54 at each corner parallel to the outer margin of the outer mat 41, these lines being a distance a+x from the outer mat margin. In conventional practice, to mark the 45° lines 56 on the inner mat corners, the distance x, the border width, is measured along line 54 beyond the intersection of the trace of line 51 and line 54. The same is done along line 53 and the points thereby defined are joined forming 45° lines 56 which is thus parallel to line 51 on the outer mat, the added increments, x in length, being identified at 58 and 59 in FIG. 5. The line identified at 57 in FIGS. 5 and 6 defines the border width at each 45° corner. As will be evident from FIG. 6, however, the length of line 57 is equal, not to x, but to x (cos 45°) or 0.707(x), a dimension appreciably and visibly smaller than x, except where x is very small. In the finished product the border between the mat margins at the 45° or diagonal corners is thus smaller in width than the border along the horizontal and vertical margins of the mat apertures. To assure that the length of line 57 is equal to x, the desired length, the operator would have to divide dimension x by 0.707 and add this length, somewhat more than x, to line 57 to form line increment 58. This calculation takes time and increases the opportunity for mathematical error.

Figure 7:
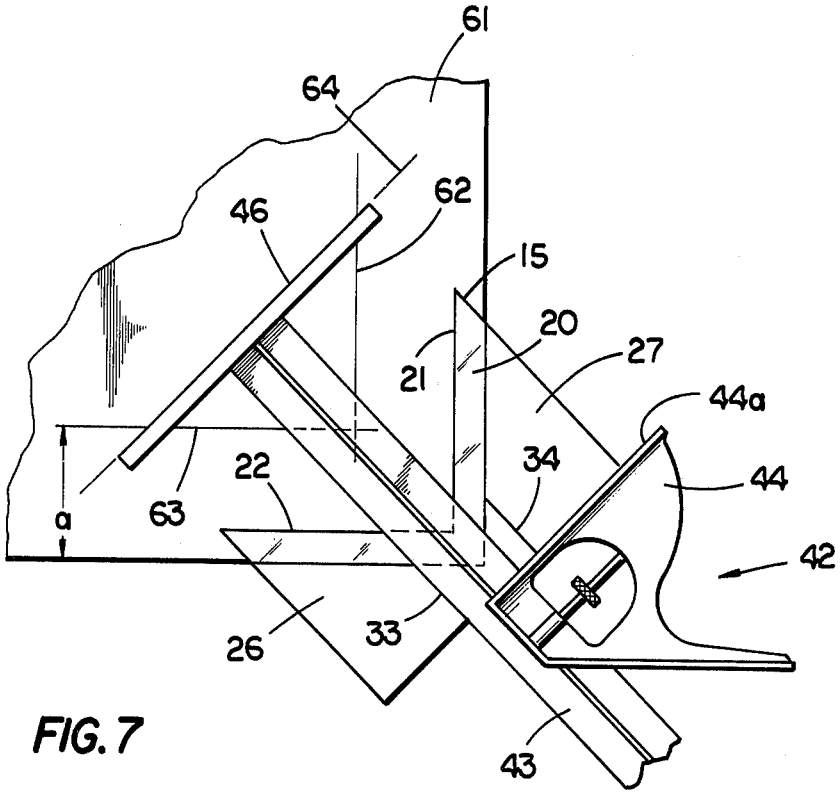
FIG. 7 is a fragmentary, top plan view of a dual mat undergoing marking while using the instrument of the present invention.

This triangulation error and a more true marking for octagonally apertured mats can be accomplished by use of the instrument of the present invention as will now be described with reference to FIGS. 7–9. The vertical and horizontal mat lines 62 and 63 are first inscribed at each mat corner and, for purposes of illustration, they are again located a distance a from the outer border of the mat. This operation is accomplished using the T-square 42 alone, just as lines 48 and 49 were located in the conventional procedure of FIG. 4.

For drawing the 45° lines 64 at each corner, the instrument of the present invention is placed against a corner of the rectangular mat stock 61 with the underface of mid-plate 20 overlying the mat and inclined margins 14 and 16 of base plate 10 abutting the outer, corner margins of the mat 41. The base surface **44*a* (FIG. 7) of the T-square member 44 is placed against the rectilinear base margin of the instrument and the shank 43 of the T-square is extended through channel 36 (FIG. 3) and held in abutting engagement with the top block margin 33. The cross member 46 of the T-square is located at the chosen location for the 45° line 64 and, after tightening member 44 on the shank 43, line 64 is drawn along the outer margin of member 46. Without changing the setting or location of member 44 or shank 43, the 45° lines 64 at the other three corners of outer mat 61 are marked. Since the 45° lines 64 are drawn without measurement along the horizontal and vertical aperture border lines 62 and 63, the octangonal block subsequently cut from the mat 61 to form the mat aperture is true and can be replaced in the aperture without regard to end-to-end orientation with the aperture thereby saving operator time as compared to the procedure described with reference to FIG. 5**.

Figure 8:
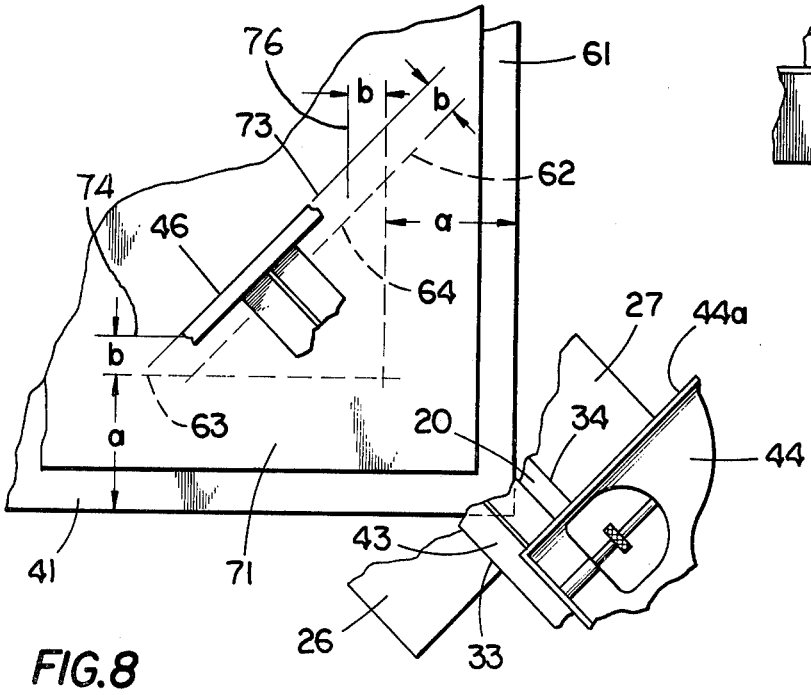
FIG. 8 is a fragmentary, top plan view illustrating the marking of dual mats using the structure of the present invention and a conventional framer's T-square.

Assuming an inner and outer mat are to be utilized, as shown in FIG. 8, an inner mat 71 is placed over the underface of outer mat 61. The border width b having been chosen, the member 44 is loosened on the shank 43 and the shank is advanced in the member 44 an amount equal to b and the member 44 reclamped on the shank. The outer margin of cross member 46 will thus be advanced a distance equal to b and inner mat 45° line 73 may be drawn. The procedure is repeated at the other three corners of inner mat 71. After the four 45° lines at each corner of the inner mat have been drawn, the T-square 42 alone may then be utilized to draw the inner mat lines 74 and 76 a distance a+b from the margins of the outer mat 61.

Figure 9:
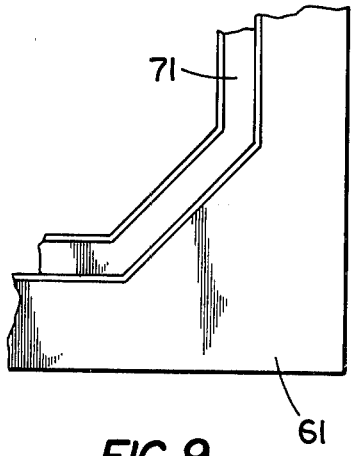
FIG. 9 is a fragmentary top plan view of a completed, dual mat having matching, octagonal mat apertures.

The octagonal aperture in the inner mat is then cut (with the outer mat in place under it) by conventional cutting appratus (not shown) and the resulting product as shown in FIG. 9 has a uniform border area width even at the 45° corner lines and this is accomplished using the instrument of the present invention in conjunction with the conventional framer's T-square without requiring any calculations, as are required with the conventional procedure described with reference to FIGS. 5 and 6.

In the preferred form of the instrument the base plate, mid-plate and top plates forming the instrument of the present invention are preferably formed of glossy acrylic plastic, mid-plate 18 being transparent and base plate and top plates 26 and 27 being opaque.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. An instrument for accurately marking picture mat for subsequent cutting comprising a member formed by a base plate having a rectilinear base margin and formed to provide a marginal right-angle identation into the plate for receiving the right angle corner of an unmarked mat, the apex of the marginal right-angle intersecting the longitudinal center line of the plate and spaced from the base margin thereof, a mid-plate having a base margin coinciding with the base margin of the base plate with its opposite end margin also formed to provide a right-angle indentation parallel to but spaced longitudinally of the indentation formed in the base plate so as to overhang the idented margin of the base plate, and two quardrilateral top plates overlying said mid-plate oriented so that their margins are coincident with those of said base plate and with their inclined end margins paralleling said right angle indentation in the mid-plate, said top plates being laterally truncated to provide a channel over said mid-plate for accommodating the shank of a T-square.

2. An instrument as claimed in claim 1 in which said base plate is formed of opaque acrylic material and at least the portion of said mid-plate which overhangs the base plate is formed of transparent acrylic material.

3. An instrument as claimed in claim 1 in which the side margins of said base and mid-plate and the outer side margins of said top plates are all rectilinear and coincident.

* * * * *